US011060535B1

(12) United States Patent
Berry

(10) Patent No.: US 11,060,535 B1
(45) Date of Patent: Jul. 13, 2021

(54) THREAD COMPENSATOR

(71) Applicant: Schlumberger Technology Corporation, Sugar Land, TX (US)

(72) Inventor: Joe Rodney Berry, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/893,934

(22) Filed: Jun. 5, 2020

(51) Int. Cl.
*F15B 13/02* (2006.01)

(52) U.S. Cl.
CPC ... *F15B 13/024* (2013.01); *F15B 2211/20515* (2013.01); *F15B 2211/6653* (2013.01)

(58) Field of Classification Search
CPC ..... F15B 13/024; F15B 2211/6653; E21B 19/16; E21B 19/06
See application file for complete search history.

(56) References Cited

U.S. PATENT DOCUMENTS

2016/0215592 A1* 7/2016 Helms ..... E21B 41/00

* cited by examiner

*Primary Examiner* — Abiy Teka
*Assistant Examiner* — Daniel S Collins

(57) ABSTRACT

A thread compensator for performing casing running operations. An example method may include visually ascertaining operational parameters of a thread compensator displayed on a video output device. The thread compensator may be connected between a top drive and a travelling block, and a casing running tool may be connected to the top drive. The operational parameters may include the height that the top drive is lifted by the thread compensator and force applied to casing by the top drive. The method may further comprise manually controlling well construction equipment to perform casing running operations based on the ascertained operational parameters.

20 Claims, 3 Drawing Sheets

THREAD COMPENSATOR

BACKGROUND OF THE DISCLOSURE

Wells are generally drilled into the ground or ocean bed to recover natural deposits of oil, gas, and other materials that are trapped in subterranean formations. Well construction (e.g., drilling, casing) operations may be performed at a wellsite surface by a well construction system (e.g., a drilling rig) having various surface and subterranean well construction equipment operating in a coordinated manner. For example, a top drive can be utilized to rotate and advance a drill string into the formation to drill a wellbore. After the wellbore is complete, casing may be deployed within the wellbore to stabilize the wellbore and isolate the wellbore from the formation.

During casing running operations, a casing string may be assembled within the wellbore by threadedly connecting casing joints at the wellsite surface and continuously deploying the casing string into the wellbore after each new casing joint is connected. For example, each new casing joint may be temporarily connected to the top drive, which is then lowered to stab the new casing joint onto an upper end of the casing string extending from the wellbore and rotated to threadedly engage the new casing joint with the upper end of the existing casing string. However, when the new casing joint is stabbed onto the upper end of the casing string, the weight of the top drive and the new casing joint may result in a large compression force being applied to the mating threads of the new casing joint and the previously connected casing joint forming the upper end of the casing string. Furthermore, while the top drive is rotating the new casing joint to threadedly engage the male threads of the new casing joint with the female threads of the previously connected casing joint, the axial movement of the new casing joint (due to more and more threads engaging) results in a large tension force being formed between the mating threads. The large compression and tension forces experienced by the mating threads during casing running operations can cause excessive stresses in the threads and thus damage the threads.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a thread compensator for controlling tension on casing during casing make-up operations performed by a top drive. The thread compensator includes a cylinder operable to support the top drive from a travelling block. The thread compensator also includes a pressure relief valve fluidly connected with the cylinder and operable to relieve hydraulic fluid from the cylinder at a relief pressure that is reached when a corresponding maximum tension is applied to the cylinder. The pressure relief valve is operable to inhibit tension on the cylinder and thus tension on the casing from exceeding the maximum tension during casing make-up operations.

The present disclosure also introduces an apparatus including a thread compensator, a video output device, and a controller comprising a processor and a memory storing a computer program code. The thread compensator is for controlling force applied to casing during casing make-up operations performed by a top drive. The thread compensator includes a cylinder operable to support the top drive from a travelling block and a pressure sensor fluidly connected with the cylinder and operable to facilitate cylinder pressure data indicative of pressure within the cylinder. During the casing make-up operations, the controller is operable to receive the cylinder pressure data, calculate force data based on the cylinder pressure data and indicative of the force applied to the casing, and output the force data to the video output device for display to rig personnel, thereby permitting the rig personnel to control hoisting equipment to adjust the force that is applied to the casing.

The present disclosure also introduces a method including visually ascertaining operational parameters of a thread compensator displayed on a video output device. The thread compensator is connected between a top drive and a travelling block. A casing running tool is connected to the top drive. The operational parameters include height that the top drive is lifted by the thread compensator and force applied to casing by the top drive. The method also includes manually controlling well construction equipment to perform casing running operations based on the ascertained operational parameters.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
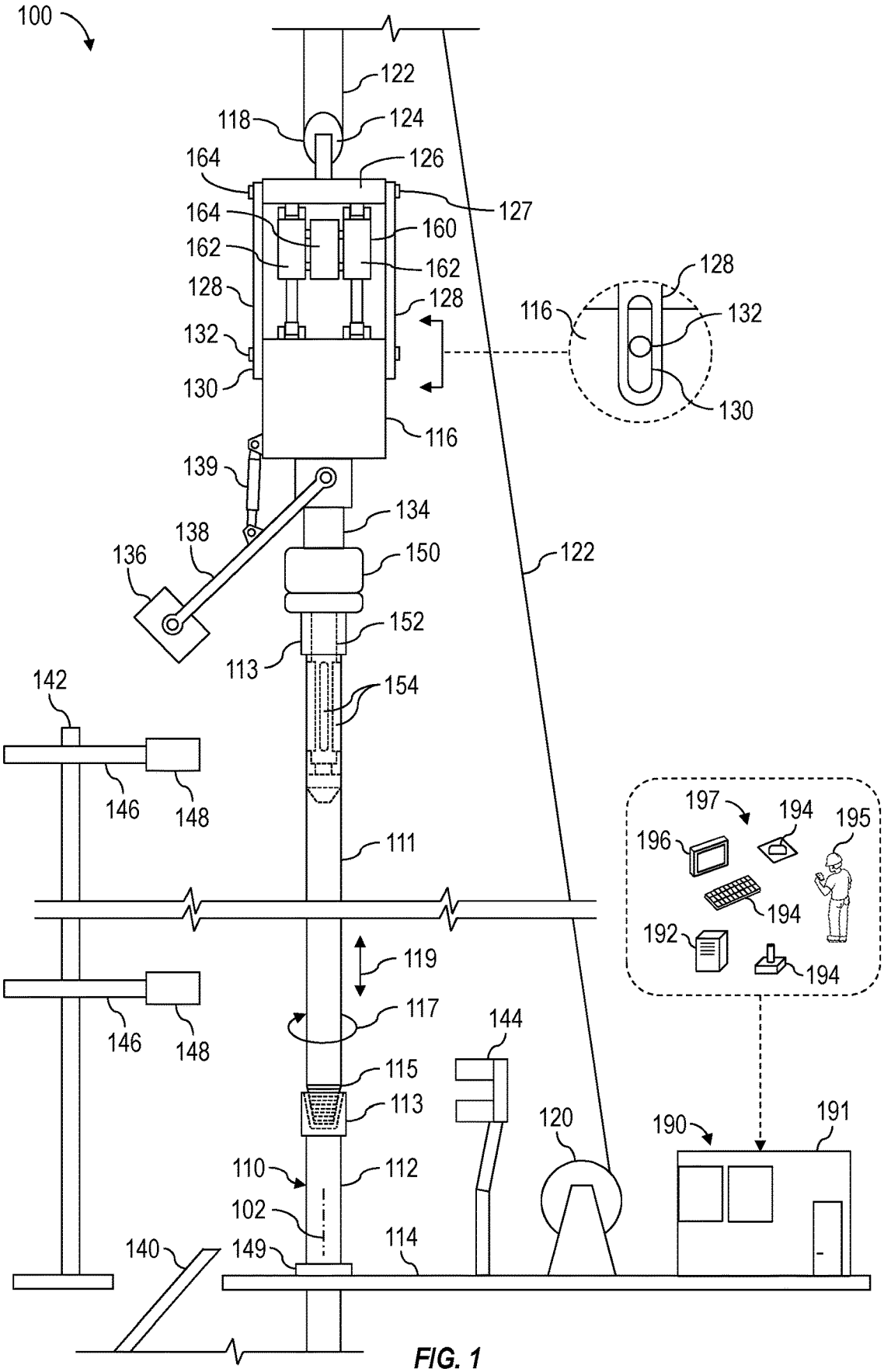
FIG. 1 is a schematic view of at least a portion of an example implementation of apparatus according to one or more aspects of the present disclosure.

It is to be understood that the following disclosure describes many example implementations for different aspects introduced herein. Specific examples of components and arrangements are described below to simplify the present disclosure. These are merely examples, and are not intended to be limiting. In addition, the present disclosure may repeat reference numerals and/or letters in the various examples. This repetition is for simplicity and clarity, and does not in itself dictate a relationship between the various implementations described herein. Moreover, the formation of a first feature over or on a second feature in the description that follows may include implementations in which the first and second features are formed in direct contact, and may also include implementations in which additional features may be formed interposing the first and second features, such that the first and second features may not be in direct contact.

Systems and methods (e.g., processes, operations, etc.) according to one or more aspects of the present disclosure may be utilized or otherwise implemented in association with an automated well construction system (i.e., a well construction rig) at an oil and gas wellsite, such as for constructing a wellbore for extracting hydrocarbons (e.g., oil and/or gas) from a subterranean formation. However, one or more aspects of the present disclosure may be utilized or otherwise implemented in association with other automated systems in the oil and gas industry and other industries. For example, one or more aspects of the present disclosure may be implemented in association with wellsite systems for performing fracturing, cementing, acidizing, chemical injecting, and/or water jet cutting operations, among other examples. One or more aspects of the present disclosure may also be implemented in association with mining sites, building construction sites, and/or other work sites where automated machines or equipment are utilized.

FIG. 1 is a schematic view of at least a portion of an example implementation of a well construction system 100 according to one or more aspects of the present disclosure. The well construction system 100 represents an example environment in which one or more aspects introduced in the present disclosure may be implemented. The well construction system 100 may be or comprise a well construction (e.g., drilling) rig operable to construct (e.g., drill) a wellbore (not shown).

The well construction system 100 comprises a mast, a derrick, and/or other support structure (not shown) disposed over a rig floor 114. The support structure and the rig floor 114 may be collectively supported over the wellbore by legs (not shown) extending to a wellsite surface. The well construction system 100 further comprises well construction equipment, including surface equipment located at the wellsite surface and downhole equipment installed or otherwise disposed within a wellbore.

The well construction equipment comprises a top drive 116 operable to directly or indirectly connect with an upper end of a tubular string 110 (e.g., a drill string, a casing string, etc.) or an individual tubular 111 (e.g., a drill pipe, a drill collar, a casing joint, etc.), and to impart rotary motion 117 and vertical motion 119 to the tubular string 110 or the individual tubular 111. The top drive 116 may comprise a drive shaft 134 extending therefrom at a lower end of the top drive 116. The drive shaft 134 may be operatively connected with a prime mover (e.g., an electric motor) (not shown) of the top drive 116, such as via a gear box or transmission (not shown). The drive shaft 134 may be selectively coupled with the upper end 113 (the box end) of the tubular string 110 or the upper end 113 (the box end) of the individual tubular 111. The top drive 116 may be selectively operated to rotate the drive shaft 134 and, thus, the individual tubular 111 coupled with the drive shaft 134. The top drive 116 may further comprise an elevator 136 pivotably connected with a body of the top drive 116 via elevator links 138. An actuator 139 may swing or otherwise move the links 138 and the elevator 136 between a lowered position and a raised position. The elevator links 138 and the elevator 136 may be used to connect with and move (e.g., lift) individual tubulars that are not mechanically coupled to the drive shaft 134.

The top drive 116 may be suspended from the support structure via a hoisting system or equipment, which may include a traveling block 118, a stationary crown block (not shown), and a drawworks 120 storing a support cable or line 122. The crown block may be or comprise a sheave connected to or otherwise supported by the support structure. The traveling block 118 may comprise a sheave 124 and a connection block 126. The sheave 124 may be reeved to the crown block via the support line 122. The connection block 126 may be connected to the top drive 116 via a plurality (e.g., two or four) of support links 128 extending between the connection block 126 and the top drive 116. An upper end of each support link 128 may be pivotably connected to the connection block 126 via a pivot pin 127, thereby facilitating pivoting motion of the support links 128 with respect to the traveling block 118. A lower end of each support link 128 may be pivotably and slidably connected with the top drive 116 via a pivot pin 132. Each support link 128 may comprise a slot 130 (e.g., an elongated hole) extending longitudinally along the lower end of each support link 128. Each slot 130 may be configured to accommodate a corresponding pivot pin 132 (or trunnion) connected to the top drive 116, thereby permitting the top drive 116 to pivot with respect to the support links 128 and to move vertically toward and away from the traveling block 118. The range of vertical motion of the top drive 116 may be limited or defined by the length of each slot 130. Each support link 128 may comprise a slot 130 having a length ranging between about 150 millimeters (about six inches) and about 300 millimeters (about 12 inches).

The drawworks 120 may be mounted on or otherwise supported by the rig floor 114. The support line 122 may be reeved around the crown block and the sheave 124 of the traveling block 118 to operatively connect the crown block, the traveling block 118, and the drawworks 120. The drawworks 120 may selectively impart tension to the support line 122 to lift and lower the travelling block 118 and the top drive 116, resulting in the vertical motion 119 of the top drive 116. The drawworks 120 may comprise a drum, a base, and a prime mover (e.g., an electric motor) (not shown) operable to drive the drum to rotate and reel in the support line 122, causing the traveling block 118 and the top drive 116 to move upward. The drawworks 120 may be further operable to reel out the support line 122 via a controlled rotation of the drum, causing the traveling block 118 and the top drive 116 to move downward.

During operations (e.g., drilling operations, drill string running operations, casing running operations), the top drive 116 and the hoisting system (e.g., the drawworks 120) may be used to assemble a tubular string and deploy the tubular string within the wellbore. For example, the top drive 116 may be connected to an individual tubular 111 and hoisted above the tubular string 110 suspended within the wellbore via the hoisting system mechanically coupled to the top drive 116. The lower end 115 (the pin end) of the individual tubular 111 may then be coupled to the upper end 113 of the tubular string 110 and the tubular string 110 may be lowered into the wellbore.

The well construction system 100 may further comprise a tubular handling system operable to store, move, connect, and disconnect tubulars (e.g., drill pipe, casing joints, etc.) to assemble and disassemble the tubular string 110 during operations. For example, a catwalk 140 may be utilized to convey the tubulars from a ground level, such as along the wellsite surface, to the rig floor 114, permitting a tubular handling device 142 to grab and lift the tubulars above the wellbore along a wellbore centerline 102 for connection with an upper end 113 of the tubular string 110 extending from the wellbore above the rig floor 114. The tubular handling device 142 may be disposed in association with a vertical pipe rack (not shown) for storing the tubulars. The tubular handling device 142 may be operable to transfer the tubulars between the catwalk 140 and/or the vertical pipe rack and the wellbore centerline 102. For example, the tubular handling device 142 may include arms 146 terminating with clamps 148, such as may be operable to grasp and/or clamp onto one of the tubulars (or a tubular stand). The arms 146 of the tubular handling device 142 may be movable toward and away from the wellbore centerline 102, such as may permit the tubular handling device 142 to transfer the tubulars between the catwalk 140 or the vertical rack and the wellbore centerline 102.

A set of tongs 144 (e.g., automated tongs) may be positioned on the rig floor 114 to hold and/or apply torque to the individual tubular 111 disposed above the wellbore to perform or help perform tubular connection make-up and break-out operations. A set of slips 149 may be located on the rig floor 114, such as may selectively hold (e.g., grip or clamp) or permit passage of the tubular string 110 during operations. The slips 149 may be in an open position, such as during drilling or tubular running operations to permit advancement of the tubular string 110, and in a closed position, such as during tubular make-up and break-out operations to hold the tubular string 110 and thereby suspend and prevent advancement of the tubular string 110 within the wellbore.

The present disclosure is further directed to example apparatus of the well construction system 100 for performing casing running operations, namely, to assemble and deploy a casing string within the wellbore after the wellbore is formed. Accordingly, the tubular string 110 may be referred to hereinafter as a casing string 110 and the individual tubular 111 may be referred to hereinafter as a casing joint 111.

The well construction equipment of the well construction system 100 may further comprise a casing running tool 150 operable to facilitate connection between the top drive 116 and the individual casing joint 111 or casing string 110. The casing running tool 150 may be connected to the drive shaft 134 of the top drive 116, such as may permit the casing running tool 150 to be rotated by the top drive 116. The casing running tool 150 may comprise an attachment portion 152 (shown in phantom lines) selectively operable to couple the casing running tool 150 to the upper end 113 (box end) of the casing joint 111. The attachment portion 152 may be an internal attachment portion comprising a plurality of dies 154 (or slips) configured to be inserted into the upper end 113 of the casing joint 111 and operable to expand in a radially outward direction to engage an inner surface of the casing joint 111 to connect with the casing joint 111. However, the attachment portion 152 may instead be an external attachment portion (not shown) operable to extend over the upper end 113 of the casing joint 111 and engage an outer surface of the casing joint 111 to connect with the casing joint 111. The casing running tool 150 may therefore be operable to connect the top drive 116 to the casing joint 111, such as may permit the top drive 116 to rotate the casing joint 111 while the casing joint 111 is positioned above the casing string 110 extending out of the wellbore.

During make-up portions of the casing running operations, the tubular handling device 142 may transfer the individual casing joints 111 (referred to hereinafter as new casing joints 111) one at a time (or in stands of two or three casing joints) from the catwalk 140 or the vertical rack to the wellbore centerline 102 below the top drive 116, to be connected with a previously connected casing joint 112 forming the upper end 113 (the box end) of the casing string 110 extending from the wellbore. After the new casing joint 111 is positioned above the upper end 113 of the casing string 110, the top drive 116 and the casing running tool 150 may be lowered via operation of the drawworks 120 until the attachment portion 152 is inserted into the upper end 113 of the new casing joint 111. The attachment portion 152 is then activated to cause engagement between the dies 154 and the inner surface of the new casing joint 111, thereby connecting the casing running tool 150 to the new casing joint 111. The tubular handling device 142 may then release the new casing joint 111 and the drawworks 120 may be operated to lower the top drive 116 and the new casing joint 111 toward the upper end 113 of the casing string 110. After the lower end 115 (the pin end) of the new casing joint 111 reaches the upper end 113 of the previously connected casing joint 112, the top drive 116 may be operated to rotate the casing running tool 150 and the new casing joint 111, thereby causing the male threads of the lower end 115 of the new casing joint 111 to threadedly engage the female threads of the upper end 115 of the previously connected casing joint 112.

However, when the lower end 115 of the new casing joint 111 contacts the upper end 113 of the previously connected casing joint 112, a large downward force may be transferred from the new casing joint 111 to the previously connected casing joint 112, resulting in large compression force between the male threads of the new casing joint 111 and the female threads of the previously connected casing joint 112. The large compression force between the corresponding male and female threads may result in large stresses in the threads that can damage (e.g., strip, chip, crack, etc.) the threads. Also, while the top drive 116 threadedly engages the lower end 115 of the new casing joint 111 with the upper end 113 of the previously connected casing joint 112, the male threads of the new casing joint 111 descend axially downward within the female threads of the previously connected casing joint 112, decreasing the cumulative length of the casings 111, 112 being coupled and thereby pulling the new casing joint 111 and the top drive 116 downward. However, because the vertical position of the top drive 116 is fixed by the hoisting system (e.g., the line 122 and the drawworks 120), the new casing joint 111 and the top drive 116 resist being pulled downward with a progressively increasing upward force while the male threads of the new casing joint 111 threadedly engage the female threads of the previously connected casing joint 112, thereby generating a progressively increasing tension force between male threads of the new casing joint 111 and the female threads of the previously connected casing joint 112. Large tension force between the corresponding male and female threads may result in large stresses that can damage the threads.

Accordingly, a thread compensator 160 may be installed between the top drive 116 and the travelling block 118 to compensate, limit, or reduce axial compression and tension forces that may be formed, applied, or transferred to or between the male threads of the new casing joint 111 with the female threads of the previously connected casing joint 112 during the make-up operations of casing running operations. The thread compensator 160 may prevent or inhibit excessive tension and compression to be formed, applied, or transferred to or between the new casing joint 111 and the previously connected casing joint 112 during make-up and break-out operations of the casing running operations to prevent or inhibit damage to the threads caused by the excessive tension and compression forces.

The thread compensator 160 may support the top drive 116 at a predetermined position with respect to (or at a distance from) the travelling block 118 when upward and downward forces are applied to the new casing joint 111. For example, the thread compensator 160 may continue to support (counterbalance) the top drive 116 and the new casing joint 111 after the new casing joint 111 contacts the upper end 113 of the casing string 110 during casing make-up operations, thereby eliminating or reducing compression force formed between the new casing joint 111 and the previously connected casing joint 112. The thread compensator 160 may further permit the top drive 116 and the new casing joint 111 to move downward while continuing to support (counterbalance) the top drive 116 and the new casing joint 111 as the corresponding male and female threads engage during the casing make-up operations, thereby eliminating or reducing tension force formed between the new casing joint 111 and the previously connected casing joint 112. The thread compensator 160 may also permit the top drive 116 and the new casing joint 111 to move upward while continuing to support (counterbalance) the top drive 116 and the new casing joint 111 as the corresponding male and female threads disengage during the casing break-out operations, thereby eliminating or reducing compression force formed between a currently removed casing joint and an adjacent casing joint of the casing string 110.

The thread compensator 160 may initially (e.g., before make-up or break-out operations) maintain or support the top drive 116 at a position with respect to the travelling block 118 such that the pivot pins 132 of the top drive 116 are not at the upper or lower ends of the corresponding slots 130 of the support links 128, thereby permitting the top drive 116 to move downward during make-up operations and upward during break-out operations with respect to the traveling block 118, which is vertically fixed via the hoisting system. For example, the thread compensator 160 may maintain the top drive 116 at a position with respect to the travelling block 118 such that the pivot pins 132 of the top drive 116 are located at or near the center of the corresponding slots 130.

The thread compensator 160 may be a hydraulic thread compensator comprising a plurality of hydraulic cylinders (e.g., rams) 162 connected with and thereby operatively connecting together the travelling block 118 and the top drive 116. For example, one end (e.g., a cap end) of the cylinders 162 may be pivotably connected with the connection block 126 of the travelling block 118 and the other end (e.g., a rod end) of the cylinders 162 may be pivotably connected with the top drive 116, such that extension and retraction action of the cylinders 162 causes corresponding upward and downward movement of the top drive 116 with respect to the travelling block 118. The thread compensator 160 may further comprise a hydraulic fluid control section 164 comprising a plurality of hydraulic fluid control valves collectively operable to control operational parameters of the thread compensator 160.

The well construction system 100 may also comprise a control center 190 from which various portions of the well construction system 100, such as the top drive 116, the hoisting system, the tubular handling device 142, the catwalk 140, the casing running tool 150, and the thread compensator 160, among other examples, may be monitored and controlled. The control center 190 may be located on the rig floor 114 or another location of the well construction system 100. The control center 190 may comprise a facility 191 (e.g., a room, a cabin, a trailer, etc.) containing a control workstation 197, which may be operated by rig personnel 195 (e.g., a driller or another human rig operator) to monitor and control various well construction equipment or portions of the well construction system 100. The control workstation 197 may comprise or be communicatively connected with a central controller 192 (e.g., a processing device, a computer, etc.), such as may be operable to receive, process, and output information to monitor operations of and provide control to one or more portions of the well construction system 100. For example, the central controller 192 may be communicatively connected with the various surface and downhole equipment described herein, and may be operable to receive sensor signals or data from and transmit control signals or data to such equipment to perform various operations described herein, among others. The central controller 192 may store executable computer program code, instructions, and/or operational parameters or setpoints, including for implementing one or more aspects of methods and operations described herein. The central controller 192 may be located within and/or outside of the facility 191. Although it is possible that the entirety of the central controller 192 is implemented within one device, it is also contemplated that one or more components or functions of the central controller 192 may be implemented across multiple devices, some or an entirety of which may be implemented as part of the control center 190 and/or located within the facility 191.

The control workstation 197 may be operable for entering or otherwise communicating control data (e.g., commands, signals, information, etc.) to the central controller 192 and other equipment controller by the rig personnel 195, and for displaying or otherwise communicating information from the central controller 192 to the rig personnel 195. The control workstation 197 may comprise one or more input devices 194 (e.g., a keyboard, a mouse, a joystick, a touchscreen, etc.) and one or more output devices 196 (e.g., a video monitor, a touchscreen, a printer, audio speakers, etc.). Communication between the central controller 192, the input and output devices 194, 196, and the various well construction equipment may be via wired and/or wireless communication means. However, for clarity and ease of understanding, such communication means are not depicted, and a person having ordinary skill in the art will appreciate that such communication means are within the scope of the present disclosure.

Figure 2:
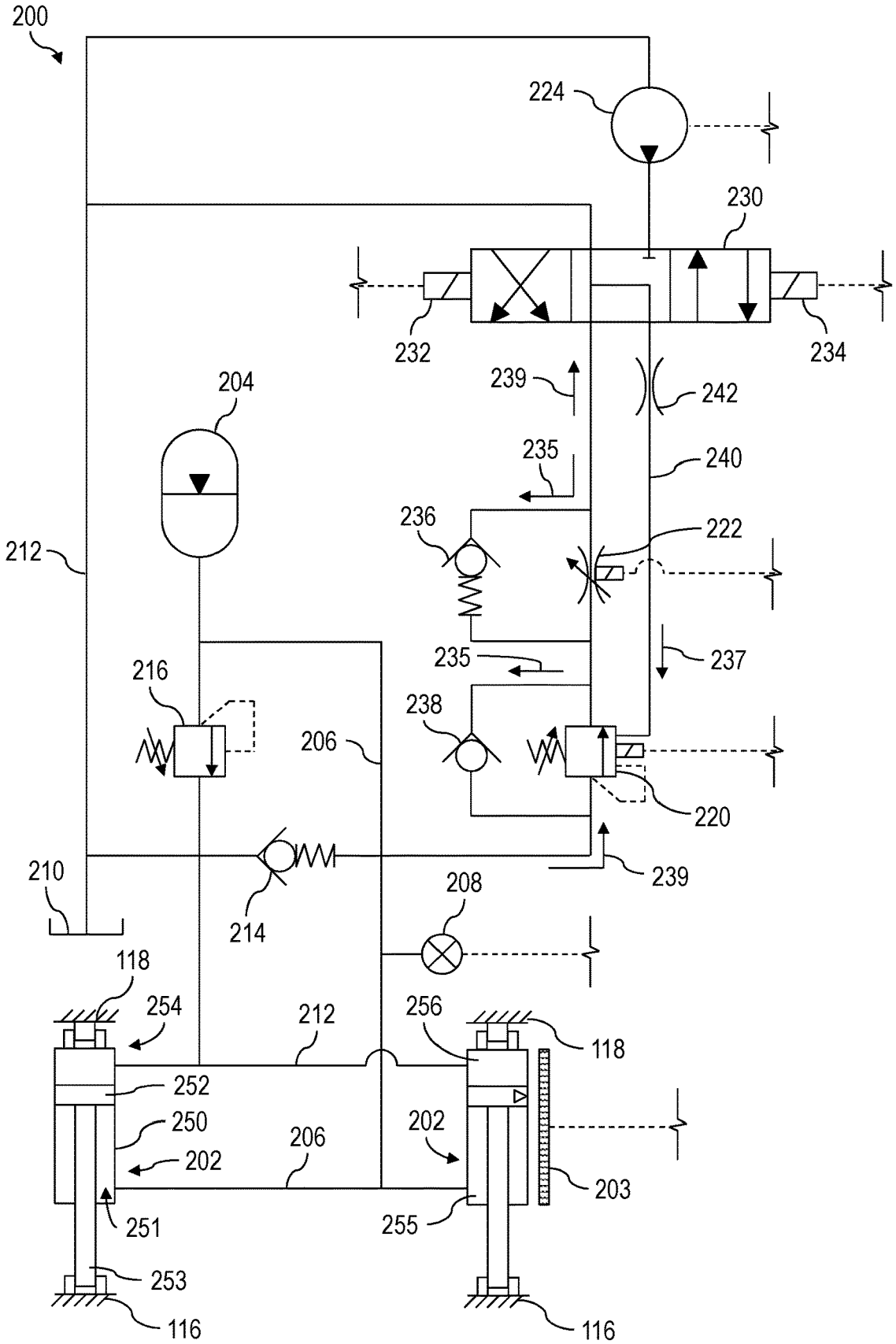
FIG. 2 is a schematic view of at least a portion of an example implementation of the apparatus shown in FIG. 1 according to one or more aspects of the present disclosure.

FIG. 2 is a schematic view of at least a portion of an example implementation of a hydraulic thread compensator 200 operable to compensate, limit, or reduce axial compression and tension forces formed, applied, or transferred to or between corresponding pin and box ends of casing joints during casing make-up and break-out operations. The hydraulic thread compensator 200 may comprise one or more features and modes of operation of the thread compensator 160 described above and shown in FIG. 1. For example, the hydraulic thread compensator 200 shown in FIG. 2 may be the thread compensator 160 shown in FIG. 1. Accordingly, one or more aspects of the following description of the hydraulic thread compensator 200 are presented in the context of FIG. 1.

The thread compensator 200 may comprise one or more hydraulic cylinders 202 (e.g., the cylinders 162 shown in FIG. 1) connected with and thereby operatively connecting together the travelling block 118 and the top drive 116. For example, each cylinder 202 may comprise a tube or other type of body 250 defining or otherwise containing a sealed chamber 251, a piston 252 slidably disposed in the chamber 251, and a rod 253 attached to the piston 252 and extending from a lower end of the chamber 251. An upper end 254 of each cylinder 202 may be pivotably connected with the travelling block 118, and the lower end of the rod 253 of each cylinder 202 may be pivotably connected with the top drive 116, such that upward and downward movement of the top drive 116 with respect to the travelling block 118 causes corresponding retraction and extension action of the cylinders 202.

One or both of the cylinders 202 may comprise or be associated with a position sensor 203 operable to output or otherwise facilitate position data (e.g., signals or measurements) indicative of position and/or velocity of the piston 252, the rod 253, and/or another portion of the cylinders 202 with respect to the body 250 of the cylinders 202. The sensor 203 may be disposed in association with the body 250 of one or both of the cylinders 202 in a manner permitting sensing of the position (i.e., amount of extension) and/or velocity of the piston-rod assembly. The sensor 203 may extend along the length of the body 250 to monitor the position and/or velocity of the piston 252 along the entire length of travel within the body 250. The position data may be indicative of position (height) of the top drive 116 along the slots 130 or otherwise with respect to the travelling block 118. Thus, the position data may be indicative of a permitted distance that the top drive 116 and, thus, a casing joint 111 may travel upward or downward with respect to the travelling block 118 during casing make-up and break-out operations. The sensor 203 may be or comprise a linear encoder, a linear potentiometer, a capacitive sensor, an inductive sensor, a magnetic sensor, and/or a linear variable-differential transformers (LVDT), among other examples.

The thread compensator 200 may further comprise a plurality of hydraulic fluid control valves collectively operable to control operational parameters of the cylinders 202 during the casing make-up and break-out operations. The thread compensator 200 may comprise a hydraulic accumulator 204 fluidly connected with the lower portion 255 (each having a moving upper boundary defined by the lower surface of the piston 252) of each chamber 251 via a pressure line 206. The hydraulic accumulator 204 may supply pressurized hydraulic fluid to the lower chamber portions 255 to maintain a predetermined pressure therein, thereby maintaining lifting force of the cylinders 202 at a predetermined level. The hydraulic accumulator 204 therefore facilitates a spring action when an external force is applied to the cylinders 202, such as when the cylinders 202 are forced to extend during casing make-up operations or retract during stabbing and break-out operations.

A pressure sensor 208 may be fluidly connected along the pressure line 206. The pressure sensor 208 may be operable to output or otherwise facilitate pressure data (e.g., measurements) indicative of fluid pressure within the accumulator 204 and the lower chamber portions 255.

An upper portion 256 of each chamber 251 (having a moving lower boundary defined by the upper surface of the piston 252) may be fluidly connected with a tank 210 via a tank return line 212. A check valve (e.g., spring-operated) 214 may be connected between the pressure line 206 and the tank line 212 to prevent hydraulic fluid from flowing from the pressure line 206 to the tank line 212. A pressure relief valve 216 may also be connected between the pressure line 206 and the tank line 212 to permit hydraulic fluid to be relieved to the tank 210 from the lower chamber portions 255 and the hydraulic accumulator 204 at a predetermined high pressure, and thus prevent the hydraulic cylinders 202 and the hydraulic accumulator 204 from overpressurizing during casing running operations or other well construction operations. The pressure relief valve 216 may be an adjustable pressure relief valve having a relief pressure that is adjustable.

The thread compensator 200 may further comprise a pressure relief valve 220 fluidly connected between or separating the pressure line 206 and the tank line 212. The pressure relief valve 220 may be an adjustable pressure relief valve having a relief pressure that is adjustable. The pressure relief valve 220 may permit the hydraulic fluid within the lower chamber portions 255 to escape and flow (i.e., relieve) to the tank 210 when the hydraulic pressure within the pressure line 206 (and the hydraulic accumulator 204) reaches a level that is higher than the set relief pressure of the pressure relief valve 220 when the cylinders 202 are forced to extend during casing make-up operations or other operations. Because the hydraulic pressure within the lower chamber portions 255 cannot exceed the set relief pressure of the pressure relief valve 220, the pressure relief valve 220 sets a maximum level of tension that can be formed or transferred between corresponding pin and box ends of casing joints when the cylinders 202 are forced to extend during casing make-up operations.

The pressure relief valve 220 may be a manually controlled pressure relief valve, wherein the relief pressure may be adjusted manually (e.g., via a control knob) by rig personnel. The pressure relief valve 220 may also or instead be a remotely (e.g., electrically, pneumatically, etc.) controlled pressure relief valve (e.g., a proportional pressure relief valve), wherein the relief pressure may be adjusted remotely via a control signal. For example, the remotely adjustable pressure relief valve may comprise an actuator (e.g., a solenoid, a pneumatic actuator, etc.) operable to receive a control signal (e.g., an electrical signal, a pneumatic signal, etc.) and proportionally adjust the relief pressure of the pressure relief valve based on the control signal. The control signal may be transmitted automatically to the pressure relief valve 220 by a controller based on programming. The control signal may instead be transmitted to the pressure relief valve 220 from a control workstation based on a manual command input by rig personnel.

Because the pressure relief valve 220 is adjustable, the pressure relief valve 220 may be or comprise the primary or exclusive means for controlling the maximum level of tension that can be formed or transferred between corresponding pin and box ends of casing joints when the cylinders 202 are forced to extend during casing make-up operations. For example, the pressure relief valve 220 may be used in combination with hydraulic accumulator 204 that is undersized with respect to the size (e.g., stroke length, bore and rod diameter) of the hydraulic cylinders 202. An undersized hydraulic accumulator 204 may conserve space or reduce total size of the thread compensator 200, but also cause internal pressure to increase relatively quickly when the hydraulic cylinders 202 are extended, resulting in a relatively large tension to be formed or transferred when the cylinders 202 are forced to extend during casing make-up operations. The pressure relief valve 220 may be used to control the maximum level of tension that can be formed or transferred when the pressure within the hydraulic accumulator 204 and the cylinders 202 increases above a predetermined level. The hydraulic accumulator 204 may instead be omitted from the thread compensator 200, such that the pressure relief valve 220 may be or comprise the sole means for controlling the maximum level of tension that can be formed or transferred between corresponding pin and box ends of casing joints when the cylinders 202 are forced to extend during casing make-up operations.

The pressure relief valves 216, 220 permit hydraulic fluid to be relieved to the tank 210 from the lower chamber portions 255 and the hydraulic accumulator 204 at predetermined pressures to prevent the hydraulic cylinders 202 and the hydraulic accumulator 204 from overpressurizing or otherwise being damaged during casing running operations or other well construction operations, such as when the casing string 110 is lifted or supported by the hoisting system and the top drive 116. The pressure relief valve 216 may be set to a higher relief pressure than the pressure relief valve 220. For example, the pressure relief valve 216 may be set to a relief pressure that is between about 250 pounds per square inch (PSI) and 750 PSI higher than the relief pressure of the pressure relief valve 220. For example, the pressure relief valve 216 may be set to a relief pressure ranging between about 2750 PSI and 3000 PSI and the pressure relief valve 220 may be set to a relief pressure ranging between about 2250 PSI and 2500 PSI.

The thread compensator 200 may further comprise a flow rate control valve 222 fluidly connected between the pressure relief valve 220 and the tank 210. The flow rate control valve 222 may be an adjustable flow rate control valve having a flow through rate that is adjustable. The flow rate control valve 222 may control flow rate of the hydraulic fluid flowing out of the lower chamber portions 255 into the tank 210 via the pressure relief valve 220, such as when the cylinders 202 are forced to extend during casing make-up operations. The flow rate control valve 222 may create a back pressure between the pressure relief valve 220 and the flow rate control valve 222 (i.e., downstream from pressure relief valve 220 and upstream from the flow rate control valve 222) when the hydraulic fluid flows out of the lower chamber portions 255 into the tank 210 via the pressure relief valve 220. Because the pressure relief valve 220 operates (i.e., relieves fluid) based on a pressure differential across the pressure relief valve 220, the back pressure may increase the pressure at which the hydraulic fluid is relieved via the pressure relief valve 220 by the amount (i.e., level) of back pressure created by the flow rate control valve 222.

Thus, when the hydraulic fluid flows out of the lower chamber portions 255 into the tank 210 via the pressure relief valve 220 and the flow rate control valve 222 at a relatively low flow rate, the back pressure may also be relatively low or negligible, thereby permitting the pressure relief valve 220 to open at substantially the predetermined (i.e., set) relief pressure of the pressure relief valve 220. For example, when the cylinders 202 are extended at a relatively low speed, such as during casing make-up operations, the cylinders 202 may maintain a tension force that is substantially constant and having a level that is predetermined based on the relief pressure setting of the pressure relief valve 220, thereby preventing large stresses from being applied to the corresponding male and female threads during casing make-up operations.

However, at relatively high flow rates, the back pressure created by the flow rate control valve 222 may be relatively high, thereby increasing the relief pressure at which the pressure relief valve 220 relieves the hydraulic fluid from the lower chamber portions 255. For example, when the cylinders 202 are extended at a relatively high speed, such as when the hoisting system (e.g., the drawworks 120) accelerates (or yanks) the top drive 116 (and perhaps an individual casing joint 111 or the casing string 110 connected to the top drive 116) upward at a high rate, hydraulic fluid may be relieved from the lower chamber portions 255 via the pressure relief valve 220 and the flow rate control valve 222 at a relatively high flow rate, thereby increasing the backpressure caused by the flow rate control valve 222 and consequently increasing the relief pressure at which the pressure relief valve 220 relieves the hydraulic fluid. The increased relief pressure may cause the cylinders 202 to extend at a substantially lower speed than if the hydraulic fluid was relieved by the pressure relief valve 220 at the actual relief pressure setting. Thus, while the hydraulic fluid is relieved from the lower chamber portions 255 in a controlled manner via the pressure relief valve 220 and the flow rate control valve 222, the cylinders 202 may progressively extend in a controlled manner, cushioning or otherwise reducing the sudden acceleration (or shock) imparted by the hoisting system to the top drive.

The flow rate control valve 222 may be a manually controlled flow rate control valve, wherein the flow through rate may be adjusted manually (e.g., via a control knob) by rig personnel. The flow rate control valve 222 may also or instead be a remotely (e.g., electrically, pneumatically, etc.) controlled flow rate control valve (e.g., a proportional flow rate control valve), wherein the flow through rate may be adjusted remotely via a control signal. For example, the remotely adjustable flow rate control valve may comprise an actuator (e.g., a solenoid, a pneumatic actuator, etc.) operable to receive a control signal (e.g., an electrical signal, a pneumatic signal, etc.) and proportionally adjust the flow through rate of the flow rate control valve based on the control signal. The control signal may be transmitted automatically by a controller based on programming. The control signal may instead be transmitted from a control workstation based on a manual command input by rig personnel.

The thread compensator 200 may further comprise or be fluidly connected with a hydraulic fluid source 224, such as a hydraulic fluid pump, fluidly connected to the tank 210 and a hydraulic directional control valve 230 selectively operable to fluidly connect the fluid source 224 to the pressure line 206. The hydraulic directional control valve 230 may be operated to selectively fluidly connect the fluid source 224 to the pressure line 206 to permit pressurized hydraulic fluid to be supplied to the hydraulic accumulator 204 and/or to retract the cylinders 202. For example, the directional control valve 230 may be shifted by a first actuator 232 (e.g., an electromagnetic coil) to a first position in which the directional control valve 230 directs the pressurized fluid from the fluid source 224 to the pressure line 206 and disconnects the tank 210 from the pressure line 206. The pressurized fluid from the fluid source 224 may then flow toward the pressure line 206, as indicated by arrows 235, bypassing the flow rate control valve 222 via a check valve 236 and then bypassing the pressure relief valve 220 via a check valve 238.

The hydraulic directional control valve 230 may also be operated to selectively fluidly connect the tank 210 to the pressure line 206, and disconnect the fluid source 224 from the pressure line 206, such as to relieve or drain the pressure line 206. For example, the directional control valve 230 may be shifted by a second actuator 234 (e.g., an electromagnetic coil) to a second position, in which the directional control valve 230 fluidly connects the pressure line 206 to the tank 210 and fluidly connects the fluid source 224 to a pilot line 240 fluidly connected to the pressure relief valve 220. The pressurized hydraulic fluid from the fluid source 224 may flow into the pilot line 240, as indicated by arrows 237, to force the pressure relief valve 220 to open, permitting the hydraulic fluid within the pressure line 206 and, thus, within the hydraulic accumulator 204 and cylinders 202 to flow to the tank 210 through the pressure relief valve 220 and the flow rate control valve 222, as indicated by arrows 239, thereby relieving hydraulic pressure from the pressure line 206, the hydraulic accumulator 204, and the cylinders 202. A flow rate control valve 242 (e.g., a reducing orifice) may be connected along the pilot line 240 to reduce flow rate through the pilot line 240 and reduce pressure shock to the relief valve 220 that may be generated when the fluid source 224 is suddenly connected to pilot line 240. While in a neutral (i.e., not actuated) position, the directional control valve 230 may fluidly isolate the fluid source 224 from the pressure line 206 and the pilot line 240, and fluidly connect the pilot line 240 and the flow rate control valve 222 and pressure relief valve 220 with the tank 210, thereby permitting the thread compensator 200 to be used to prevent or inhibit excessive compression and tension forces on the casing during casing running operations, as described herein.

The fluid source 224, the actuators of the fluid valves 220, 222, 230, and the sensors 203, 208 may be communicatively or otherwise electrically connected to a controller, such as the central controller 192. Such communicative connection may permit the controller to receive sensor data from the sensors 203, 208 to monitor operational status of the thread compensator 200. Such communicative connection may further permit the controller to output control data to the fluid source 224 and the actuators of the fluid valves 220, 222, 230 to control operation of the thread compensator 200.

Figure 3:
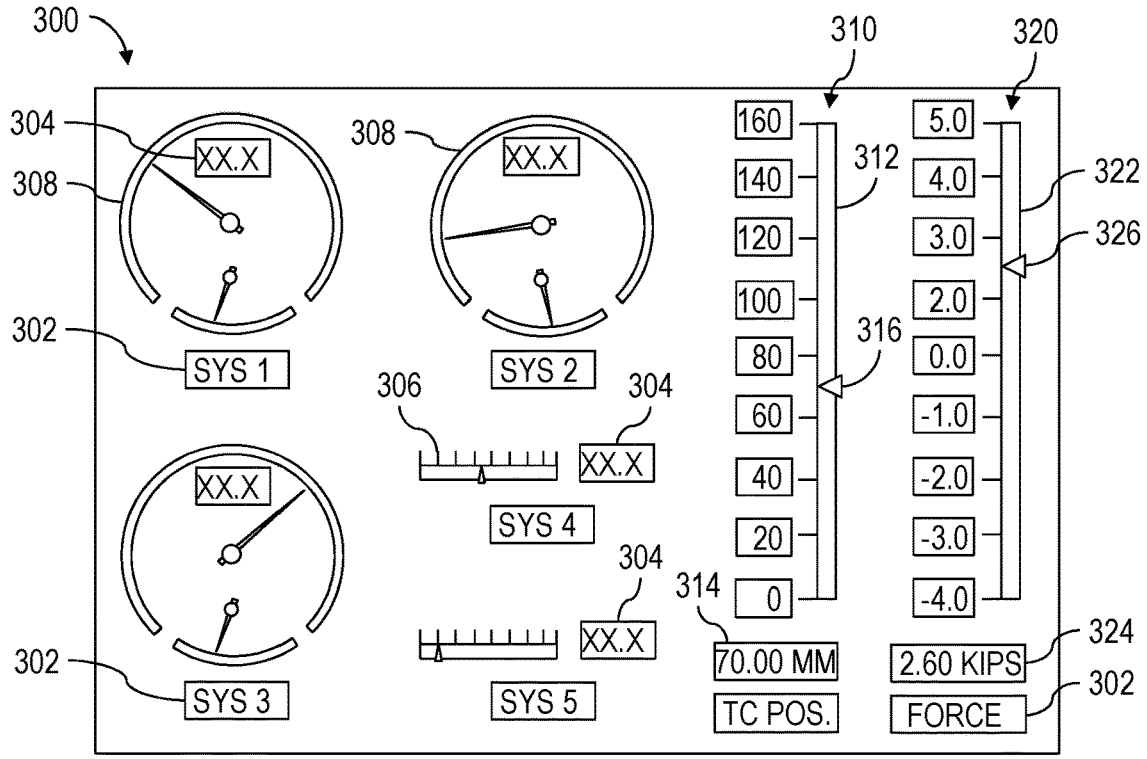
FIG. 3 is an example implementation of a screen displayed by the apparatus shown in FIG. 1 according to one or more aspects of the present disclosure.

A control workstation, such as the workstation 197 shown in FIG. 1, may be used by rig personnel to monitor and control well construction equipment, such as the well construction equipment shown in FIGS. 1 and 2, to perform casing running operations. FIG. 3 is an example implementation of a display screen 300 according to one or more aspects of the present disclosure that may be displayed to rig personnel (e.g., a driller) on a video output device of the control workstation during casing running operations to help the rig personnel to perform the casing running operations. Accordingly, the following description refers to FIGS. 1, 2 and 3, collectively.

The display screen 300 may display selected sensor signals or information indicative of operational status of selected well construction systems, subsystems, or individual pieces of equipment. The display screen 300 may display sensor data or measurements indicative of, for example, hook load, travelling block position, top drive speed, top drive torque, number of casing joints connected, top drive tubular connection status, elevator status, stick-up connection status, and slips status. The information displayed on the display screen 300 may change during the casing running operations while different pieces of equipment are operated. The information displayed on the display screen 300 may be displayed in the form of text boxes 302 describing the sensor data, the source of the sensor data, or the piece of equipment or subsystem associated with the sensor data. The sensor data displayed on the display screen 300 may be displayed in the form of, for example, numerical values 304, tables, graphs 306, gauges 308, lights, and/or schematics.

The display screen 300 may further comprise a thread compensator position indicator 310 displaying or otherwise indicating operational position (stroke position) of the thread compensator 160/200. The thread compensator position may be or comprise the amount or distance the cylinders 162/202 lift the top drive 116. The thread compensator position may be or comprise the vertical position of the top drive 116 with respect to the travelling block 118. The thread compensator position may be or comprise the vertical position of the top drive pins 132 with respect to or along the slots 130 of the support links 128. The thread compensator position may be limited by the length of the slots 130. The thread compensator position may be calculated by a controller, such as the central controller 192 shown in FIG. 1, based on position data output by a position sensor, such as the position sensor 203 shown in FIG. 2, disposed in association with a movable component of the thread compensator 160/200 or the top drive 116. The controller may be operable to receive the position data and output the position data to the video output device for display to the rig personnel, thereby permitting the rig personnel to control the thread compensator 160/200 to change the position of the top drive 116.

The thread compensator position may be displayed in the form of a bar graph 312 and/or a text box 314 displaying actual numerical values indicating the vertical position of the top drive 116. An arrow or another indicator 316 displayed in association with the bar graph 312 may indicate the detected thread compensator position. For example, when the cylinders 162/202 are fully extended, the position indicator 310 (e.g., the bar graph 312 and/or the text box 314) may indicate a thread compensator position of zero, indicating the lowest position of the top drive 116. When the cylinders 162/202 are fully retracted, the position indicator 310 may indicate the highest position (i.e., the maximum height) (e.g., 160 millimeters) of the top drive 116.

The display screen 300 may further comprise a casing force indicator 320 displaying or otherwise indicating a force applied to or experienced by the casing during casing running operations. The force may comprise a compression force and a tension force applied by the top drive 116 and hoisting system to the casing during casing running operations. The force may be calculated by a controller (e.g., the controller 192) based on pressure data output by a pressure sensor, such as the pressure sensor 208 shown in FIG. 2, fluidly connected to the lower chamber portions 255. The pressure data may be indicative of hydraulic pressure within the lower chamber portions 255 generated by and indicative of the weight of the top drive 116 and/or a new casing joint 111 connected to the top drive 116. The controller may be operable to receive the cylinder pressure data, calculate force data indicative of the force applied to the casing based on the cylinder pressure data, and output the force data to the video output device for display to the rig personnel via the thread compensator force indicator 320, thereby permitting the rig personnel to control the hoisting system and/or the thread compensator to adjust the force that is applied to the casing.

The controller may be operable to calculate the force data by determining a counterbalance pressure within the cylinders at which the top drive and the casing joint connected to the top drive are counterbalanced (supported or rendered neutral) by the cylinders. The counterbalance pressure may be a pressure at which no force is being applied to the casing. Accordingly, the force applied to the casing (as shown via the force indicator 320) that is associated with the counterbalance pressure may be set to zero. The controller may then calculate the force applied to the casing based on difference between the pressure within the cylinders and the counterbalance pressure. The force data may comprise compression data indicative of amount of compression that is applied to the casing, and tension data indicative of amount of tension that is applied to the casing. Thus, the controller may be further operable to calculate the compression data based on amount of decrease of the pressure within the cylinders with respect to the counterbalance pressure, calculate the tension data based on amount of increase of the pressure within the cylinders with respect to the counterbalance pressure, and output the compression data and the tension data to the video output device for display to the rig personnel via the thread compensator force indicator 320, thereby permitting the rig personnel to control the hoisting system and/or the thread compensator to adjust the compression and the tension that is applied to the casing. As described below, the counterbalance pressure within the scope of the present disclosure may also or instead be determined for just the top drive and the casing running tool connected to the top drive without the casing joint, such that just the top drive and the casing running tool are counterbalanced (supported or rendered neutral) by the cylinders of the thread compensator.

The thread compensator force may be displayed in the form of a bar graph 322 and/or actual numerical values displayed in a text box 324. An arrow or another indicator 326 displayed in association with the bar graph 322 may indicate the detected force that is applied by the top drive to the casing. When the counterbalance pressure in the cylinders is reached, the force applied to the casing may be set to zero on the force indicator 320 to show that no force is being applied to the casing. Thus, during casing running operations, the force applied or experienced by the casing may be displayed with respect to a neutral or zero force, which may be displayed at a midpoint of the bar graph 322. Compression (or downward) force applied by the top drive to the casing may be displayed on an upper side of the bar graph 322, as having positive force values (e.g., ranging between 0.0 kips and 5.0 kips). Tension (or upward) force applied to the casing by the top drive may be displayed on a lower side of the bar graph 322, as having negative force values (e.g., ranging between 0.0 kips and 5.0 kips).

Figure 4:
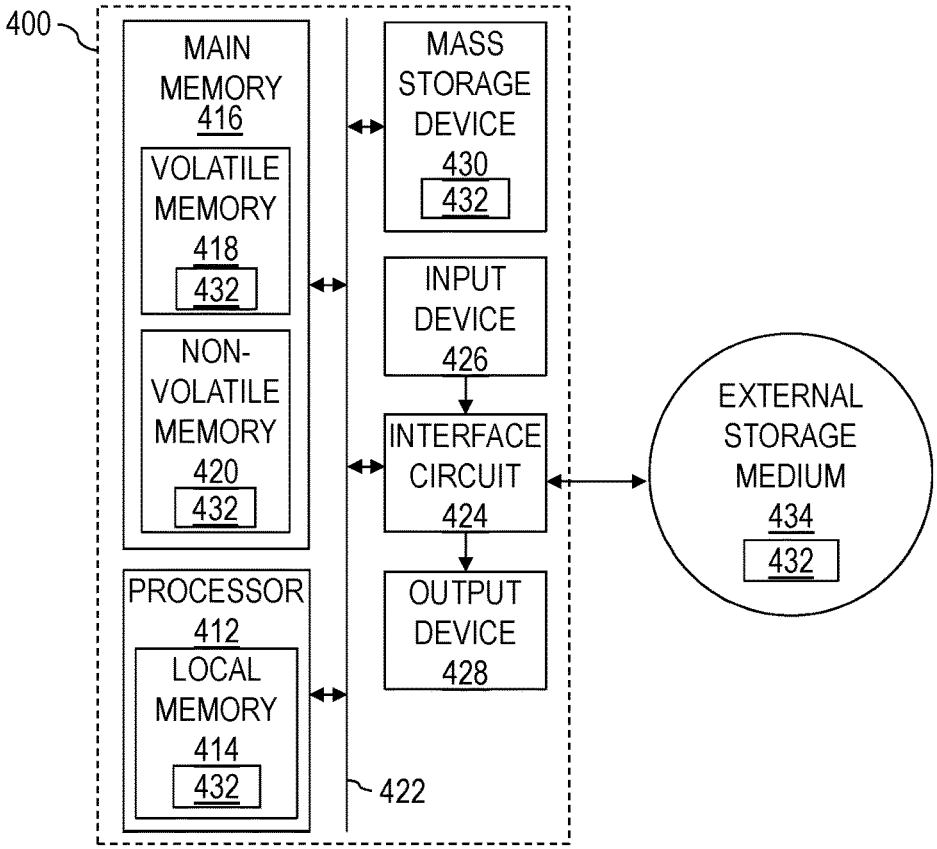
FIG. 4 is a schematic view of at least a portion of an example implementation of apparatus according to one or more aspects of the present disclosure.

FIG. 4 is a schematic view of at least a portion of an example implementation of a processing device 400 (or system) according to one or more aspects of the present disclosure. The processing device 400 may be or form at least a portion of one or more equipment controllers and/or other electronic devices shown in one or more of the FIGS. 1-3. Accordingly, the following description refers to FIGS. 1-4, collectively.

The processing device 400 may be or comprise, for example, one or more processors, controllers, special-purpose computing devices, PCs (e.g., desktop, laptop, and/or tablet computers), personal digital assistants, smartphones, IPCs, PLCs, servers, internet appliances, and/or other types of computing devices. The processing device 400 may be or form at least a portion of the central controller 192 and the control workstation 197. Although it is possible that the entirety of the processing device 400 is implemented within one device, it is also contemplated that one or more components or functions of the processing device 400 may be implemented across multiple devices, some or an entirety of which may be at the wellsite and/or remote from the wellsite.

The processing device 400 may comprise a processor 412, such as a general-purpose programmable processor. The processor 412 may comprise a local memory 414, and may execute machine-readable and executable program code instructions 432 (i.e., computer program code) present in the local memory 414 and/or another memory device. The processor 412 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 412 include one or more INTEL microprocessors, microcontrollers from the ARM and/or PICO families of microcontrollers, embedded soft/hard processors in one or more FPGAs.

The processor 412 may execute, among other things, the program code instructions 432 and/or other instructions and/or programs to implement the example methods and/or operations described herein. For example, the program code instructions 432, when executed by the processor 412 of the processing device 400, may cause the processor 412 to receive and process (e.g., compare) sensor data (e.g., sensor measurements). The program code instructions 432, when executed by the processor 412 of the processing device 400, may output control data (i.e., control commands) to cause one or more portions or pieces of well construction equipment of a well construction system 100 to perform the example methods and/or operations described herein. For example, the program code instructions 432, when executed by the processor 412 of the processing device 400, may output calculations and control data to one or more video output devices (e.g., monitors, HMIs) to cause the video output devices to display to rig personnel the calculations and the display screens described herein to help or permit the rig personnel to perform the example methods and/or operations described herein.

The processor 412 may be in communication with a main memory 416, such as may include a volatile memory 418 and a non-volatile memory 420, perhaps via a bus 422 and/or other communication means. The volatile memory 418 may be, comprise, or be implemented by random access memory (RAM), static RAM (SRAM), dynamic RAM (DRAM), synchronous DRAM (SDRAM), RAMBUS DRAM (RDRAM), and/or other types of RAM devices. The non-volatile memory 420 may be, comprise, or be implemented by read-only memory, flash memory, and/or other types of memory devices. One or more memory controllers (not shown) may control access to the volatile memory 418 and/or non-volatile memory 420.

The processing device 400 may also comprise an interface circuit 424, which is in communication with the processor 412, such as via the bus 422. The interface circuit 424 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 424 may comprise a graphics driver card. The interface circuit 424 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing device 400 may be in communication with various sensors, video cameras, actuators, processing devices, equipment controllers, and other devices of the well construction system via the interface circuit 424. The interface circuit 424 can facilitate communications between the processing device 400 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a proprietary communication protocol, and/or another communication protocol.

One or more input devices 426 may also be connected to the interface circuit 424. The input devices 426 may permit the rig personnel to enter the program code instructions 432, which may be or comprise control data, operational parameters, operational set-points, a well construction plan, and/or a database of operational sequences. The program code instructions 432 may further comprise modeling or predictive routines, equations, algorithms, processes, applications, and/or other programs operable to perform example methods and/or operations described herein. The input devices 426 may be, comprise, or be implemented by a keyboard, a mouse, a joystick, a touchscreen, a track-pad, a trackball, an isopoint, and/or a voice recognition system, among other examples. One or more output devices 428 may also be connected to the interface circuit 424. The output devices 428 may permit for visualization or other sensory perception of various data, such as sensor data, status data, and/or other example data. The output devices 428 may be, comprise, or be implemented by video output devices (e.g., an LCD, an LED display, a CRT display, a touchscreen, etc.), printers, and/or speakers, among other examples. The one or more input devices 426 and the one or more output devices 428 connected to the interface circuit 424 may, at least in part, facilitate the HMIs described herein.

The processing device 400 may comprise a mass storage device 430 for storing data and program code instructions 432. The mass storage device 430 may be connected to the processor 412, such as via the bus 422. The mass storage device 430 may be or comprise a tangible, non-transitory storage medium, such as a floppy disk drive, a hard disk drive, a compact disk (CD) drive, and/or digital versatile disk (DVD) drive, among other examples. The processing device 400 may be communicatively connected with an external storage medium 434 via the interface circuit 424. The external storage medium 434 may be or comprise a removable storage medium (e.g., a CD or DVD), such as may be operable to store data and program code instructions 432.

As described above, the program code instructions 432 may be stored in the mass storage device 430, the main memory 416, the local memory 414, and/or the removable storage medium 434. Thus, the processing device 400 may be implemented in accordance with hardware (perhaps implemented in one or more chips including an integrated circuit, such as an ASIC), or may be implemented as software or firmware for execution by the processor 412. In the case of firmware or software, the implementation may be provided as a computer program product including a non-transitory, computer-readable medium or storage structure embodying computer program code instructions 432 (i.e., software or firmware) thereon for execution by the processor 412. The program code instructions 432 may include program instructions or computer program code that, when executed by the processor 412, may perform and/or cause performance of example methods, processes, and/or operations described herein.

The present disclosure is further directed to example methods (e.g., operations and/or processes) for performing casing running operations. The methods may be performed by utilizing or otherwise in conjunction with at least a portion of one or more implementations of one or more instances of the apparatus shown in one or more of FIGS. 1-4, and/or otherwise within the scope of the present disclosure. The methods may be caused to be performed, at least partially, by a processing device, such as the processing device 400 executing program code instructions according to one or more aspects of the present disclosure. Thus, the present disclosure is also directed to a non-transitory, computer-readable medium comprising computer program code that, when executed by the processing device, may cause such processing device to perform the example methods described herein. The methods may also or instead be caused to be performed, at least partially, by a human wellsite operator utilizing one or more instances of the apparatus shown in one or more of FIGS. 1-4, and/or otherwise within the scope of the present disclosure. Thus, the following description of example methods refer to apparatus shown in one or more of FIGS. 1-4. However, the methods may also be performed in conjunction with implementations of apparatus other than those depicted in FIGS. 1-4 that are also within the scope of the present disclosure.

An example method according to one or more aspects of the present disclosure may comprise an initialization procedure for the thread compensator 160, including determining a counterbalance pressure that is to be applied to the hydraulic cylinders 162 to counterbalance or support the weight of the top drive 116 and the casing running tool 150 connected thereto. The method may comprise fully rigging up the top drive 116 and the casing running tool 150 for casing running operations, hoisting the top drive 116 to an upper (fully raised) position for adding a casing joint (or a casing stand), operating the thread compensator 160 in a casing make-up mode, receiving by a controller pressure sensor data output by the pressure sensor 208, and determining weight of the top drive based on the pressure sensor data. The determined counterbalance pressure may also be used in a casing running tool engagement mode and in a casing break-out mode.

An example method according to one or more aspects of the present disclosure may comprise a casing running tool engagement procedure. The method may comprise, while the thread compensator is in the make-up mode, operating the directional control valve 230 to the first position and then operating the pump 224 to pump hydraulic fluid into the rod ends (e.g., lower chamber portions 255) of the cylinders 162 to retract the cylinders 162 thereby raising the top drive 116 to midstroke, namely until the pivot pins 132 are raised to a midpoint of the slots 130 of the support links 128. The total length of the slots 130 define a total or maximum stroke of the thread compensator 160. Thus, if the slots 130 have a length of about 150 millimeters, the top drive 116 may be raised about 75 millimeters until the pivot pins 132 are at a midpoint of the slots 130. Accordingly, the thread compensator position indicator 310 of the display screen 300 shows a position or height of 75 millimeters. Such positioning may facilitate top drive strokes that are symmetric with respect to the midpoint of the slots 130, thereby permitting the top drive 116 to move 75 mm in the upward and downward directions during the make-up and break-out operations. When the top drive 116 is positioned midstroke, the counterbalance pressure may be associated with (or set to) a thread compensator force (or load) having a zero value. Accordingly, the force indicator 320 of the display screen 300 may show a force of 0.0 kips.

The top drive 116 and the casing running tool 150 may then be lowered into contact with the top end of the new casing joint 111. When the casing running tool 150 contacts the upper end (box end) of the new casing joint 111, the drawworks 120 may be slacked off until a predetermined force (e.g., ranging between about 4.0 kips and about 5.0 kips) is read on the force indicator 320. The top drive 116 may then be rotated clockwise to engage the casing running tool 150 with the new casing joint 111 to connect the casing running tool 150 and, thus, the top drive 116 to the new casing joint 111. The top drive 116 may move upward (e.g., by 1.625 inches) while the dies 154 of the casing running tool 150 extend to engage the inner surface of the new casing joint 111. While top drive 116 moves upward when the casing running tool 150 engages the new casing joint 111, the cylinders 162 may retract while downward force (e.g., set-down force) applied to the new casing joint 111 increases. The rig personnel (e.g., the driller) may operate the drawworks 120 to hoist the top drive 116 upward to reduce or minimize the downward force applied to the new casing joint 111. However, if the increased downward force is not excessive or is otherwise within a predetermined threshold, then the rig personnel may not have to hoist the top drive 116 upward. The rig personnel may continuously monitor the downward force by viewing the thread compensator force indicator 320 of the display screen 300.

An example method according to one or more aspects of the present disclosure may comprise using torque data as a casing connection interlock data. For example, status of connection between the top drive 116 and the new casing collar 111 may be determined based on level of torque output by the top drive 116 while the casing running tool 150 engages the new casing joint 111. Thus, when the top drive 116 reaches a predetermined torque threshold (e.g., around 3000 foot-pounds), the central controller 192 may use torque data output by the top drive 116 as a tubular interlock signal indicating that the top drive 116 is fully connected with the new casing joint 111. When the threshold torque is achieved and the tubular interlock is active, the drawworks 120 and the top drive 116 may be further operated to make-up the new casing joint 111 with the upper end 113 of the casing string 110.

An example method according to one or more aspects of the present disclosure may comprise using the thread compensator 160 while releasing the casing running tool 150 from the casing string 110 after lowering the casing string 110 into the wellbore. For example, after the casing string 110 is lowered into the wellbore, the slips 149 may be set against the casing string 110 and the thread compensator 160 may be operated to the break-out mode for a predetermined period of time (e.g., for about 2 seconds). The thread compensator force indicator 320 may then be set to zero. When the slips 149 are set and the thread compensator 160 has been initialized, the drawworks 120 may continue to lower the top drive 116 until the thread compensator force indicator 320 shows a predetermined force (e.g., ranging between about 6.0 kips and about 9.0 kips). The top drive 116 may then be rotated slowly counter-clockwise until timing strips of the casing running tool 150 are aligned and colors match. The top drive 116 may be pulled down as the dies 154 disengage from the inner surface of the casing string 110 and the force on the thread compensator force indicator 320 may decrease. The casing running tool 150 may get shorter while the top drive 116 is rotated counter-clockwise.

An example method according to one or more aspects of the present disclosure may comprise using the thread compensator 160 while breaking out and laying down casing joints 111. For example, while the thread compensator 160 is operating in the break-out mode, counter-clockwise torque limit may be set to a predetermined low torque value (e.g., 2000 foot-pounds) at which casing running tool 150 is permitted to rotate to the break-out cams. The top drive 116 may be rotated counter-clockwise by a predetermined angle (e.g., about 20 degrees). If the predetermined low torque value was not reached in the predetermined angle, the rotation of the top drive 116 may be stopped and an alarm may be output, as the casing running tool 150 may be disengaging rather than engaging the back out cams. While the thread compensator 160 is operated in the break-out mode (e.g., charges for about 2-seconds and turns off), the thread compensator 160 may be engaged when the break-out torque has been reached. The top drive 116 may continue to be rotated counter-clockwise, permitting the thread compensator 160 to move up as the connection is disengaged. When breaking out a double of casing, there is a risk of breaking the intermediate connection when rotating counter-clockwise. There is also a risk of breaking out the casing running tool 150 connection to the top drive 116. Therefore, scribe lines on thread connections may be visually checked.

An example method according to one or more aspects of the present disclosure may comprise performing casing running operations. Such method may include rig personnel visually ascertaining operational parameters of the thread compensator 160 displayed on a screen 300 of a video output device 196 and manually controlling the well construction equipment of the well construction system 100 to perform the casing running operations based on the ascertained operational parameters. Manually controlling the well construction equipment to perform the casing running operations may comprise manually controlling the drawworks 120 to move the top drive 116 based on the operational parameters ascertained by the rig personnel. The operational parameters may comprise position or height that the top drive 116 is lifted by the thread compensator 160 and force applied to the casing 111, 112 by the top drive 116. The force applied to the casing 111, 112 may comprise a downward force (compression) applied to the casing 111, 112 and an upward force (tension) applied to the casing 111, 112. The video output device 196 may display the force applied to the casing 111, 112 as a graph 322 comprising a midpoint indicating that no force is being applied to the casing 111, 112, a first side indicating the downward force that is applied to the casing 111, 112, and a second side indicating the upward force that is applied to the casing 111, 112.

Manually controlling the well construction equipment to perform the casing running operations may comprise, before connecting the casing running tool 150 to a new casing joint 111, causing the drawworks 120 to move the top drive 116 (and the casing running tool 150) upward until the top drive 116 is fully supported by the drawworks 120, setting the force applied to the casing 111, 112 by the top drive 116 that is displayed on the video output device 196 to zero, and causing the thread compensator 160 to lift the top drive 116 to a predetermined height (e.g., midpoint of the total available stroke of the thread compensator 160). Manually controlling the well construction equipment to perform the casing running operations may also or instead comprise, before performing casing make-up operations, operating the drawworks 120 and the top drive 116 to connect the casing running tool 150 to a new casing joint 111, setting the force applied to the casing 111, 112 by the top drive 116 that is displayed on the video output device 196 to zero, and causing the thread compensator 160 to lift the top drive 116 to a predetermined height.

Another example method of performing casing running operations may include stabbing and setting the casing running tool 150 within a new casing joint 111 (or stand of casing joints) to connect the top drive 116 to the new casing joint 111. For example, while a rotating portion of the tongs 144 is positioned at the well center 102 and a backup portion of the tongs 144 is clamped on the casing string 110 extending from the wellbore (i.e., a casing stump), the new casing joint 111 may be positioned at wellbore center 102 via the tubular handling device 142. The new casing joint 111 may be lowered, stabbing the lower end 115 (pin end) of the new casing joint 111 into the upper end 113 (box end) of the casing stump. No plate may be included on top of the casing stump. The tongs 144 may provide a stabbing guide that may guide the pin end into the box end. The method may include using the tongs 144 to make up the connection, after which, the casing running tool 150 may be lowered into the upper end 113 of the new casing joint 111. The top drive 116 may then be lowered, inserting the casing running tool 150 into the box end of the new casing joint 111. The thread compensator 160 may then be operated in the make-up mode and the stabbing portion 152 (e.g., a quill) of the casing running tool 150 may be inserted into the upper end 113 of the new casing joint 111. Such operation may provide a soft stab in case of hang-up during insertion. The stabbing portion 152 may continue to be lowered into the new casing joint 111. When an air spring of the casing running tool 150 contacts the upper end 113 of the new casing joint 111, the top drive 116 may continue to be lowered until a predetermined downward force is reached. The downward force may be observed on the force indicator 320 displayed on the display screen 300. The predetermined downward force may range between about 2.0 kips and about 7.0 kips.

The casing running tool 150 may then be engaged against an internal surface of the new casing joint 111 to connect the casing running tool 150 and, thus, the top drive 116 to the new casing joint 111. To connect the casing running tool 150 to the new casing joint 111, the top drive 116 may be rotated in the clockwise direction. If the casing string 110 is made up using the casing running tool 150, the casing running tool 150 may continue to be rotated until the make-up cycle is complete. However, if the casing string 110 is made up at the rig floor 114 using the tongs 144 and the casing running tool 150 is to be used just for lowering the casing string 110 into the wellbore, then the top drive 116 may be rotated until a predetermined portion (e.g., about 20%) of the casing make-up torque is achieved. The predetermined portion to the casing make-up torque may be set to a minimum torque level (e.g., about 4000 foot-pounds (about 5 kilo Newton-meters)), insuring sufficient engagement of the casing running tool dies 154 against the inner surface of the new casing joint 111. The make-up torque may then be released and the new casing joint becomes a portion of the casing string 110.

The thread compensator 160 may then be disengaged and the top drive 116 may be hoisted upwards by the drawworks 120 to take a portion of the casing string load before the slips 149 can be released. While the casing string 110 is being hoisted, the slips 149 may be released and the casing running tool 150 may be monitored to determine if the dies 154 are engaged with the casing string 110. The tubular handling device 142 may then release the casing string 110 and retract from the wellbore center 102.

The casing string 110 may then be run in hole. For example, the casing string 110 may be lowered into the wellbore until the upper end 113 of the casing string 110 is positioned at an intended height above the rig floor 114. The slips 149 may then be set and the casing string load may be transferred from the casing running tool 150 to the slips 149. The thread compensator position indicator 310 (e.g., the bar graph 312) may be monitored for increase in stroke, indicating that the casing string 110 is supported by the slips 149. The top drive 116 may continue to be lowered until the force indicator 320 (e.g., the bar graph 322) indicates a downward force greater than a predetermined level (e.g., ranging between about 6.0 kips and about 9.0 kips).

The casing running tool 150 may then be operated to release the casing string 110. For example, while maintaining the predetermined downward force, the top drive 116 may be rotated counter-clockwise the same number of rotations required to engage the casing running tool 150 or until the radial stripes on the casing running tool 150 are aligned and with matching colors. The number of rotations required to engage the casing running tool 150 is not obtainable when using the casing running tool 150 to make up the casing string 110. When the casing make-up operations are performed by the tong 144 and the casing running tool 150 is used just for hoisting, the central controller 192 may be used to count the number of rotations to get to the 20% of make-up torque, as described above, before hoisting the casing string 110. When disengaging the casing running tool 150, the central controller 192 may cause the top drive 116 to rotate counter-clockwise the same number of rotations that were taken in the clockwise direction to engage the casing running tool 150 with the new casing joint 111. When the casing running tool 150 is disengaged from the casing string 110, the top drive 116 may be hoisted upwards to remove the casing running tool 150 from the upper end 113 of the casing string 110 extending from the wellbore.

Each casing joint may be disconnected from the casing string 110 and laid down. For example, while the casing running tool 150 is fully engaged with the upper casing joint of the casing string 110 and no top drive weight is sitting on the casing string 110, the top drive 116 may be rotated counter-clockwise past the alignment marks. The reverse break-out torque should increase instantaneously thereafter. However, if the break-out torque does not increase, that means that the casing running tool 150 is being disengaged and the counter-clockwise rotation should be stopped. After the break-out cycle is complete, the top drive 116 may be hoisted upward to remove the lower end 115 of the casing joint 111 from the upper end 113 of the casing string 110 extending from the wellbore. A stump guide may then be placed over the upper end 113 of the casing string 110 extending from the wellbore. The top drive 116 may then be lowered until the lower end 115 of the casing joint 111 contacts the stump guide and until the top drive 116 applies a predetermined downward force (e.g., ranging between about 6.0 kips and about 9.0 kips). The downward force may be monitored based on the force indicator 320 displayed on the display screen 300. The tongs 144 may be used to provide back-up on the casing joint 112 sitting on the upper end of the casing string 110 extending from the wellbore. The top drive 116 and the casing running tool 150 may then be rotated a predetermined angle (e.g., 90 degrees) in the counter-clockwise direction until the radial stripes on the casing running tool 150 are aligned and colors match.

In view of the entirety of the present disclosure, including the figures and the claims, a person having ordinary skill in the art will readily recognize that the present disclosure introduces an apparatus comprising a thread compensator for controlling tension on casing during casing make-up operations performed by a top drive, wherein the thread compensator comprises: a cylinder operable to support the top drive from a travelling block; and a pressure relief valve fluidly connected with the cylinder and operable to relieve hydraulic fluid from the cylinder at a relief pressure that is reached when a corresponding maximum tension is applied to the cylinder, wherein the pressure relief valve is operable to inhibit tension on the cylinder and thus tension on the casing from exceeding the maximum tension during casing make-up operations.

The pressure relief valve may be able to be shifted to an open position in which the pressure relief valve permits free flow therethrough thereby permitting the hydraulic fluid to flow out of the cylinder to lower the top drive.

The thread compensator may comprise a check valve fluidly connected in parallel with the pressure relief valve. The check valve may permit the hydraulic fluid to bypass the pressure relief valve and flow from a hydraulic fluid source to retract the cylinder, thereby raising the top drive.

The thread compensator may comprise a flow rate control valve fluidly connected with the pressure relief valve such that the pressure relief valve relieves the hydraulic fluid through the flow rate control valve. The flow rate control valve may be operable to cause back pressure between the pressure relief valve and the flow rate control valve, thereby increasing the relief pressure and thus the maximum tension that can be applied to the casing. In such implementations, among others within the scope of the present disclosure, the thread compensator may further comprise a check valve fluidly connected in parallel with the flow rate control valve. The check valve may permit the hydraulic fluid to bypass the flow rate control valve and flow from a hydraulic fluid source to retract the cylinder thereby raising the top drive. The flow rate control valve may be a remotely controlled flow rate control valve operable to receive control signals and adjust flow through rate based on the control signals.

The pressure relief valve may be a remotely controlled pressure relief valve operable to receive control signals and adjust the relief pressure based on the control signals. In such implementations, among others within the scope of the present disclosure, the thread compensator may not comprise a hydraulic accumulator fluidly connected with the cylinder.

The present disclosure also introduces an apparatus comprising: (A) a thread compensator for controlling force applied to casing during casing make-up operations performed by a top drive, wherein the thread compensator comprises: (1) a cylinder operable to support the top drive from a travelling block; and (2) a pressure sensor fluidly connected with the cylinder and operable to facilitate cylinder pressure data indicative of pressure within the cylinder; (B) a video output device; and (C) a controller comprising a processor and a memory storing a computer program code, wherein during the casing make-up operations the controller is operable to: (1) receive the cylinder pressure data; (2) calculate force data based on the cylinder pressure data, wherein the force data is indicative of the force applied to the casing; and (3) output the force data to the video output device for display to rig personnel thereby permitting the rig personnel to control hoisting equipment to adjust the force that is applied to the casing.

The thread compensator may comprise a position sensor operable to facilitate position data indicative of position of the top drive caused by the thread compensator, and during the casing make-up operations the controller may be further operable to: receive the position data; and output the position data to the video output device for display to the rig personnel, thereby permitting the rig personnel to control the thread compensator to change the position of the top drive. The controller may be operable to calculate the force data by: determining a counterbalance pressure within the cylinder at which the top drive is counterbalanced by the cylinder; and calculating the force applied to the casing based on a difference between the pressure within the cylinder and the counterbalance pressure. The thread compensator may comprise a position sensor operable to facilitate position data indicative of position of the top drive caused by the thread compensator, and during the casing make-up operations the controller may be further operable to: receive the position data; and output the position data to the video output device for display to the rig personnel, thereby permitting the rig personnel to control the thread compensator to change the position of the top drive. The force data may comprise: compression data indicative of an amount of compression that is applied to the casing; and tension data indicative of an amount of tension that is applied to the casing. The controller may be further operable to: determine a counterbalance pressure within the cylinder at which the top drive and a casing joint connected to the top drive are counterbalanced by the cylinder; calculate the compression data based on an amount of decrease of the pressure within the cylinder with respect to the counterbalance pressure; calculate the tension data based on an amount of increase of the pressure within the cylinder with respect to the counterbalance pressure; and output the compression data and the tension data to the video output device for display to the rig personnel, thereby permitting the rig personnel to control hoisting equipment to adjust the compression and the tension that is applied to the casing. During the casing make-up operations, the controller may be operable to display the force data as a graph comprising: a midpoint indicating that no force is being applied to the casing; a first side indicating amount of compression that is applied to the casing; and a second side indicating amount of tension that is applied to the casing.

The present disclosure also introduces a method comprising: (A) visually ascertaining operational parameters of a thread compensator displayed on a video output device, wherein the thread compensator is connected between a top drive and a travelling block, wherein a casing running tool is connected to the top drive, and wherein the operational parameters comprise: (1) height that the top drive is lifted by the thread compensator; and (2) force applied to casing by the top drive; and (B) manually controlling well construction equipment to perform casing running operations based on the ascertained operational parameters.

The force applied to the casing may comprise: a downward force applied to the casing; and an upward force applied to the casing.

The video output device may display the force applied to the casing as a graph comprising: a midpoint indicating that no force is being applied to the casing; a first side indicating a downward force that is applied to the casing; and a second side indicating an upward force that is applied to the casing.

Manually controlling the well construction equipment to perform the casing running operations may comprise manually controlling a drawworks to move the top drive based on the ascertained operational parameters.

Manually controlling the well construction equipment to perform the casing running operations may comprise, before connecting the casing running tool to a new casing joint: causing a drawworks to move the top drive upward until the top drive is fully supported by the drawworks; causing the thread compensator to lift the top drive to a predetermined height; and setting the force applied to the casing by the top drive that is displayed on the video output device to zero.

Manually controlling the well construction equipment to perform the casing running operations may comprise, before performing casing make-up operations: operating a drawworks and the top drive to connect the casing running tool to a new casing joint; when the top drive and the casing joint are fully supported by the drawworks, causing the thread compensator to lift the top drive to a predetermined height; and setting the force applied to the casing by the top drive that is displayed on the video output device to zero.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

What is claimed is:

1. An apparatus comprising:

a thread compensator for controlling tension on casing during casing make-up operations performed by a top drive, wherein the thread compensator comprises:

a cylinder operable to support the top drive from a travelling block; and a pressure relief valve fluidly connected with the cylinder and operable to relieve hydraulic fluid from the cylinder at a relief pressure that is reached when a corresponding maximum tension is applied to the cylinder, wherein the pressure relief valve is operable to inhibit tension on the cylinder and thus tension on the casing from exceeding the maximum tension during casing make-up operations.

2. The apparatus of claim 1 wherein the pressure relief valve can be shifted to an open position in which the pressure relief valve permits free flow therethrough thereby permitting the hydraulic fluid to flow out of the cylinder to lower the top drive.

3. The apparatus of claim 1 wherein the thread compensator further comprises a check valve fluidly connected in parallel with the pressure relief valve, and wherein the check valve permits the hydraulic fluid to bypass the pressure relief valve and flow from a hydraulic fluid source to retract the cylinder thereby raising the top drive.

4. The apparatus of claim 1 wherein the thread compensator further comprises a flow rate control valve fluidly connected with the pressure relief valve such that the pressure relief valve relieves the hydraulic fluid through the flow rate control valve, and wherein the flow rate control valve is operable to cause back pressure between the pressure relief valve and the flow rate control valve thereby increasing the relief pressure and thus the maximum tension that can be applied to the casing.

5. The apparatus of claim 4 wherein the thread compensator further comprises a check valve fluidly connected in parallel with the flow rate control valve, and wherein the check valve permits the hydraulic fluid to bypass the flow rate control valve and flow from a hydraulic fluid source to retract the cylinder thereby raising the top drive.

6. The apparatus of claim 4 wherein the flow rate control valve is a remotely controlled flow rate control valve operable to receive control signals and adjust flow through rate based on the control signals.

7. The apparatus of claim 1 wherein the pressure relief valve is a remotely controlled pressure relief valve operable to receive control signals and adjust the relief pressure based on the control signals.

8. The apparatus of claim 7 wherein the thread compensator does not comprise a hydraulic accumulator fluidly connected with the cylinder.

9. An apparatus comprising:

a thread compensator for controlling force applied to casing during casing make-up operations performed by a top drive, wherein the thread compensator comprises:

a cylinder operable to support the top drive from a travelling block; and a pressure sensor fluidly connected with the cylinder and operable to facilitate cylinder pressure data indicative of pressure within the cylinder;

a video output device; and a controller comprising a processor and a memory storing a computer program code, wherein during the casing make-up operations the controller is operable to:

receive the cylinder pressure data;

calculate force data based on the cylinder pressure data, wherein the force data is indicative of the force applied to the casing; and output the force data to the video output device for display to rig personnel thereby permitting the rig personnel to control hoisting equipment to adjust the force that is applied to the casing.

10. The apparatus of claim 9 wherein the thread compensator comprises a position sensor operable to facilitate position data indicative of position of the top drive caused by the thread compensator, and wherein during the casing make-up operations the controller is further operable to:

receive the position data; and output the position data to the video output device for display to the rig personnel thereby permitting the rig personnel to control the thread compensator to change the position of the top drive.

11. The apparatus of claim 9 wherein the controller is operable to calculate the force data by:

determining a counterbalance pressure within the cylinder at which the top drive is counterbalanced by the cylinder; and calculating the force applied to the casing based on a difference between the pressure within the cylinder and the counterbalance pressure.

12. The apparatus of claim 11 wherein the thread compensator comprises a position sensor operable to facilitate position data indicative of position of the top drive caused by the thread compensator, and wherein during the casing make-up operations the controller is further operable to:

receive the position data; and output the position data to the video output device for display to the rig personnel thereby permitting the rig personnel to control the thread compensator to change the position of the top drive.

13. The apparatus of claim 9 wherein:

the force data comprises:

compression data indicative of an amount of compression that is applied to the casing; and tension data indicative of an amount of tension that is applied to the casing; and the controller is further operable to:

determine a counterbalance pressure within the cylinder at which the top drive and a casing joint connected to the top drive are counterbalanced by the cylinder;

calculate the compression data based on an amount of decrease of the pressure within the cylinder with respect to the counterbalance pressure;

calculate the tension data based on an amount of increase of the pressure within the cylinder with respect to the counterbalance pressure; and output the compression data and the tension data to the video output device for display to the rig personnel thereby permitting the rig personnel to control hoisting equipment to adjust the compression and the tension that is applied to the casing.

14. The apparatus of claim 9 wherein during the casing make-up operations the controller is operable to display the force data as a graph comprising:

a midpoint indicating that no force is being applied to the casing;

a first side indicating amount of compression that is applied to the casing; and a second side indicating amount of tension that is applied to the casing.

15. A method comprising:

visually ascertaining operational parameters of a thread compensator displayed on a video output device, wherein the thread compensator is connected between a top drive and a travelling block, wherein a casing running tool is connected to the top drive, and wherein the operational parameters comprise:

height that the top drive is lifted by the thread compensator; and force applied to casing by the top drive; and manually controlling well construction equipment to perform casing running operations based on the ascertained operational parameters.

16. The method of claim 15 wherein the force applied to the casing comprises:

a downward force applied to the casing; and an upward force applied to the casing.

17. The method of claim 15 wherein the video output device displays the force applied to the casing as a graph comprising:

a midpoint indicating that no force is being applied to the casing;

a first side indicating a downward force that is applied to the casing; and a second side indicating an upward force that is applied to the casing.

18. The method of claim 15 wherein manually controlling the well construction equipment to perform the casing running operations comprises manually controlling a drawworks to move the top drive based on the ascertained operational parameters.

19. The method of claim 15 wherein manually controlling the well construction equipment to perform the casing running operations comprises, before connecting the casing running tool to a new casing joint:

causing a drawworks to move the top drive upward until the top drive is fully supported by the drawworks;

causing the thread compensator to lift the top drive to a predetermined height; and setting the force applied to the casing by the top drive that is displayed on the video output device to zero.

20. The method of claim 15 wherein manually controlling the well construction equipment to perform the casing running operations comprises, before performing casing make-up operations:

operating a drawworks and the top drive to connect the casing running tool to a new casing joint;

when the top drive and the casing joint are fully supported by the drawworks, causing the thread compensator to lift the top drive to a predetermined height; and setting the force applied to the casing by the top drive that is displayed on the video output device to zero.

* * * * *